US009242762B2

(12) United States Patent
Imai et al.

(10) Patent No.: US 9,242,762 B2
(45) Date of Patent: Jan. 26, 2016

(54) BOTTLE

(75) Inventors: Hiroaki Imai, Tokyo (JP); Tadayori Nakayama, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 93 days.

(21) Appl. No.: 13/881,273

(22) PCT Filed: Oct. 21, 2011

(86) PCT No.: PCT/JP2011/074302

§ 371 (c)(1),
(2), (4) Date: Apr. 24, 2013

(87) PCT Pub. No.: WO2012/057026

PCT Pub. Date: May 3, 2012

(65) Prior Publication Data

US 2013/0220968 A1 Aug. 29, 2013

(30) Foreign Application Priority Data

Oct. 26, 2010 (JP) ..... 2010-239946
Oct. 27, 2010 (JP) ..... 2010-240943
Oct. 27, 2010 (JP) ..... 2010-240944

(51) Int. Cl.
*B65D 90/02* (2006.01)
*B65D 23/00* (2006.01)
*B65D 1/02* (2006.01)

(52) U.S. Cl.
CPC ..... *B65D 23/00* (2013.01); *B65D 1/0261* (2013.01)

(58) Field of Classification Search
CPC ..... B65D 1/00; B65D 1/0261; B65D 1/06; B29C 49/54; B29C 49/541; B29C 49/2049; B29C 49/0892
USPC ..... 215/371, 375, 376; 220/605, 606, 607, 220/608, 609; D9/520
See application file for complete search history.

(56) References Cited

U.S. PATENT DOCUMENTS 5,763,030 A * 6/1998 Matsui ..... 428/35.7
6,409,035 B1 * 6/2002 Darr et al. ..... 215/373

(Continued)

FOREIGN PATENT DOCUMENTS

JP A 3-84735 8/1991
JP A 2005-313975 11/2005

(Continued)

OTHER PUBLICATIONS

Jan. 28, 2014 Office Action issued in Japanese Patent Application No. 2010-239945 (with translation).

(Continued)

*Primary Examiner* — Anthony Stashick
*Assistant Examiner* — Ernesto Grano
(74) *Attorney, Agent, or Firm* — Oliff PLC

(57) ABSTRACT

Provided is a bottle including a bottom part having a bottom wall part. The bottom wall part includes a grounding part located at the outer circumferential edge thereof, a standing peripheral wall part connecting to the grounding part from a radial inner side of the bottle and extending upward, an annular movable wall part projecting from an upper end of the standing peripheral wall part toward the radial inner side of the bottle, and a depression peripheral wall part extending upward from an inner end of the movable wall part in a radial direction of the bottle. The movable wall part is disposed to freely pivot around a connection part connected with the standing peripheral wall part so as to move the depression peripheral wall part in an upward direction, and the depression peripheral wall part is formed to have multiple stages.

8 Claims, 7 Drawing Sheets

(56) References Cited

U.S. PATENT DOCUMENTS

| | | | | |
|---|---|---|---|---|
| 6,595,380 | B2 * | 7/2003 | Silvers | 215/373 |
| 6,896,147 | B2 * | 5/2005 | Trude | 215/373 |
| 6,942,116 | B2 * | 9/2005 | Lisch et al. | 215/373 |
| 7,055,711 | B2 * | 6/2006 | Sasaki et al. | 215/373 |
| 7,703,618 | B2 * | 4/2010 | Derrien | 215/375 |
| 7,780,025 | B2 * | 8/2010 | Simpson et al. | 215/376 |
| 7,861,876 | B2 * | 1/2011 | Stowitts | 215/381 |
| 8,127,955 | B2 * | 3/2012 | Denner et al. | 215/373 |
| 8,276,774 | B2 * | 10/2012 | Patcheak et al. | 215/373 |
| 8,353,415 | B2 * | 1/2013 | Saito et al. | 215/373 |
| 8,485,375 | B2 * | 7/2013 | Colloud | 215/375 |
| 8,505,756 | B2 * | 8/2013 | Saito et al. | 215/376 |
| 8,584,879 | B2 * | 11/2013 | Melrose et al. | 215/373 |
| 8,616,395 | B2 * | 12/2013 | Patcheak et al. | 215/381 |
| 8,657,137 | B2 * | 2/2014 | Saito et al. | 215/377 |
| 2007/0012648 | A1 * | 1/2007 | Gatewood | 215/375 |
| 2008/0047964 | A1 * | 2/2008 | Denner et al. | 220/624 |
| 2008/0073316 | A1 * | 3/2008 | Stowitts | 215/381 |
| 2009/0159556 | A1 * | 6/2009 | Patcheak et al. | 215/373 |
| 2009/0283495 | A1 | 11/2009 | Lane et al. | |
| 2012/0248059 | A1 * | 10/2012 | Saito et al. | 215/371 |

FOREIGN PATENT DOCUMENTS

| | | | |
|---|---|---|---|
| JP | A-2008-024314 | | 2/2008 |
| JP | A-2008-050036 | | 3/2008 |
| JP | A-2008-239176 | | 10/2008 |
| JP | A-2008-254244 | | 10/2008 |
| JP | A-2008-539141 | | 11/2008 |
| JP | A 2009-501115 | | 1/2009 |
| JP | A-2010-126184 | | 6/2010 |
| JP | A-2010-235183 | | 10/2010 |
| WO | WO 2006/118584 | A1 | 11/2006 |
| WO | WO 2007/006880 | A1 | 1/2007 |
| WO | WO 2009/050346 | A1 | 4/2009 |

OTHER PUBLICATIONS

Feb. 12, 2014 Office Action issued in Japanese Patent Application No. 2010-240943 (with translation).

Dec. 27, 2011 International Search Report issued in International Application No. PCT/JP2011/074302 with English-language translation.

Jul. 2, 2014 Office Action issued in Chinese Patent Application No. 201180051398.6.

Jul. 2, 2014 Search Report issued in Chinese Patent Application No. 201180051398.6 (translated in English).

* cited by examiner

BOTTLE

TECHNICAL FIELD

The present invention relates to a bottle. This application claims priority to and the benefits of Japanese Patent Application No. 2010-239946 filed on Oct. 26, 2010, No. 2010-240944 filed on Oct. 27, 2010, and No. 2010-240943 filed on Oct. 27, 2010, the disclosures of which are incorporated herein by reference.

BACKGROUND ART

Conventionally, a configuration has been known in which, as a bottle formed of a synthetic resin material in the shape of a bottomed cylinder by blow molding, as shown in, for instance, Patent Document 1 below, a bottom wall part of a bottom part includes a grounding part located at an outer circumferential edge thereof, a standing peripheral wall part that connects to the grounding part from a radial inner side of the bottle and extends upward, an annular movable wall part that protrudes from an upper end of the standing peripheral wall part toward the radial inner side of the bottle, and a depression peripheral wall part that extends upward from an inner end of the movable wall part in a radial direction of the bottle, wherein the movable wall part pivots about a connection part with the standing peripheral wall part so as to move the depression peripheral wall part in an upward direction, thereby absorbing decompression in the bottle.

RELATED ART DOCUMENTS

Patent Documents

[Patent Document 1] Japanese Unexamined Patent Application, First Publication No. 2010-126184

SUMMARY OF INVENTION

Problems to be Solved by the Invention

However, the aforementioned conventional bottle has variability in, for instance, the thickness (wall thickness) or the rigidity of the bottom wall part thereof. Accordingly, in the conventional bottle, during decompression of the interior of the bottle, the amount of displacement of the movable wall part or the depression peripheral wall part which is directed to the inner side of the bottle is different at each position in the circumferential direction of the bottle. As such, there is a possibility of causing a problem in that the desired decompression absorption performance in the bottle cannot be stably obtained. Further, the conventional bottle has room for improvement with regard to increasing the decompression absorption performance of the interior of the bottle.

The present invention has been made taking the aforementioned circumstances into consideration, and an object of the present invention is to provide a bottle capable of increasing decompression absorption performance of the interior of the bottle and stably obtaining sufficient decompression absorption performance of the interior of the bottle.

Means for Solving the Problems

To address the aforementioned problems, according to a first aspect of the present invention, a bottle formed of a synthetic resin material in a shape of a bottomed cylinder by blow molding is configured so that a bottom wall part of a bottom part includes a grounding part located at an outer circumferential edge thereof, a standing peripheral wall part configured to connect to the grounding part from a radial inner side of the bottle and to extend upward, an annular movable wall part configured to protrude from an upper end of the standing peripheral wall part toward the radial inner side of the bottle, and a depression peripheral wall part configured to extend upward from an inner end of the movable wall part in a radial direction of the bottle. The movable wall part is disposed to freely pivot around a connection part connected with the standing peripheral wall part so as to move the depression peripheral wall part in an upward direction, and the depression peripheral wall part is formed to have multiple stages.

In this case, since the depression peripheral wall part is formed to have multiple stages, the depression peripheral wall part is formed by forcing the synthetic resin material to be greatly stretched during the blow molding of the bottle. Accordingly, reduction of a wall thickness of the depression peripheral wall part can be achieved, and when the interior of the bottle is decompressed, the depression peripheral wall part can be easily moved upward. As a result, the performance of decompression absorption of the interior of the bottle can be improved.

Further, as described above, since the depression peripheral wall part is formed by forcing the synthetic resin material to be greatly stretched during the blow molding, a degree of orientational crystallization in the depression peripheral wall part can be increased, and when a content in a heated state is filled, the depression peripheral wall part can be inhibited from being deformed.

Further, the bottom wall part may include a closing wall part closing an upper end opening of the depression peripheral wall part, and the depression peripheral wall part may include a lower cylindrical part that is gradually reduced in diameter from the inner end of the movable wall part in the radial direction of the bottle toward an upper side thereof, an upper cylindrical part that is gradually increased in diameter from an outer circumferential edge of the closing wall part toward a lower side thereof, and a step part that connects both of the cylindrical parts. The upper cylindrical part may be formed in the shape of a curved surface protruding downward.

In this case, since the upper cylindrical part is formed in the shape of a curved surface protruding in the downward direction that is a direction in which the synthetic resin material is stretched during blow molding, the fluidity of the synthetic resin material during blow molding can be increased. Accordingly, the synthetic resin material is allowed to smoothly flow with low resistance, and the moldability of the bottle can be further improved.

Further, an annular width of the movable wall part in the radial direction of the bottle may be within a range of 20% to 40% of a ground diameter in the grounding part.

In this case, when the interior of the bottle changes to a decompressed state, the depression peripheral wall part is moved upward by pivoting of the movable wall part, and thereby the decompression can be absorbed. Especially, since the annular width of the movable wall part is formed within a range of 20% to 40% of the ground diameter, the movable wall part can be flexibly deformed while following up a change in internal pressure of the interior of the bottle with good sensitivity. As a result, the decompression absorption of the interior of the bottle can be stably performed. Further, since the movable wall part easily pivots downward during the filling of the content, the volume of the interior of the bottle during filling is increased, thereby the capacity of the decompression absorption of the interior of the bottle just after the filling can be increased. As a result, the performance of the decompression absorption of the interior of the bottle can be improved.

Further, the depression peripheral wall part may be formed with an angular cylindrical part of a polygonal shape in which a plurality of overhang parts projecting toward the radial inner side of the bottle are formed in succession in the circumferential direction of the bottle, and thereby the shape thereof when viewed from a cross section thereof is configured so that midsections located between the overhang parts adjoining each other in the circumferential direction of the bottle become corner parts and so that the overhang parts become side parts.

In this case, since the angular cylindrical part is formed on the depression peripheral wall part, during the decompression of the interior of the bottle, stress is easily concentrated on corresponding portions, which are equivalent in position to the midsections forming the corner parts of the angular cylindrical parts in a circumferential direction of the bottle, of the connection part of the movable wall part and the depression peripheral wall part. Accordingly, even when the wall thickness and rigidity in the movable wall part and the depression peripheral wall part are different at each position in the circumferential direction of the bottle, during the decompression of the interior of the bottle, the movable wall part and the depression peripheral wall part can be easily displaced toward the inner side of the bottle throughout the circumferences thereof starting from the corresponding portions in the connection part. As a result, the performance of the decompression absorption of the interior of the bottle can be stably exerted.

Further, when viewed from a longitudinal section of the angular cylindrical part, each of the midsections and the overhang parts may be formed in the shape of a curved surface protruding toward the radial inner side of the bottle, and a radius of curvature of the midsection is greater than that of the overhang part.

In this case, when viewed from a longitudinal section of the angular cylindrical part, the radius of curvature of the midsection is greater than that of the overhang part. Accordingly, stress occurring at the midsections forming the corner parts of the angular cylindrical part can be suppressed. Thereby, a loss of strength of the bottom wall part caused by forming the angular cylindrical part on the depression peripheral wall part can be prevented.

Further, a shape of the angular cylindrical part when viewed from a cross section thereof may be gradually deformed form the polygonal shape into a circular shape from a lower side toward an upper side thereof.

In this case, the shape of the angular cylindrical part when viewed from the cross section thereof may be gradually deformed form the polygonal shape into the circular shape from the lower side toward the upper side thereof. Accordingly, an increase in stress concentration points can be suppressed by forming the angular cylindrical part on the depression peripheral wall part, and the strength of the bottom wall part can be reliably prevented from being reduced.

Furthermore, the depression peripheral wall part may be gradually increased in diameter from an upper side toward a lower side thereof.

In this case, the depression peripheral wall part is gradually increased in diameter from the upper side toward the lower side thereof. Accordingly, during the decompression of the interior of the bottle, a raising force is easily applied to the depression peripheral wall part toward the inner side of the bottle, and the movable wall part and the depression peripheral wall part can be reliably displaced toward the inner side of the bottle.

Furthermore, when the bottle is formed by blow molding, the moldability of the bottle can be improved.

Effects of the Invention

According to the bottle related to the present invention, a function of the decompression absorption of the interior of the bottle can be stabilized, and the bottle having excellent performance of the decompression absorption can be obtained.

MODE FOR CARRYING OUT THE INVENTION

Hereinafter, a bottle according to an embodiment of the present invention will be described with reference to the accompanying drawings.

Figure 1:
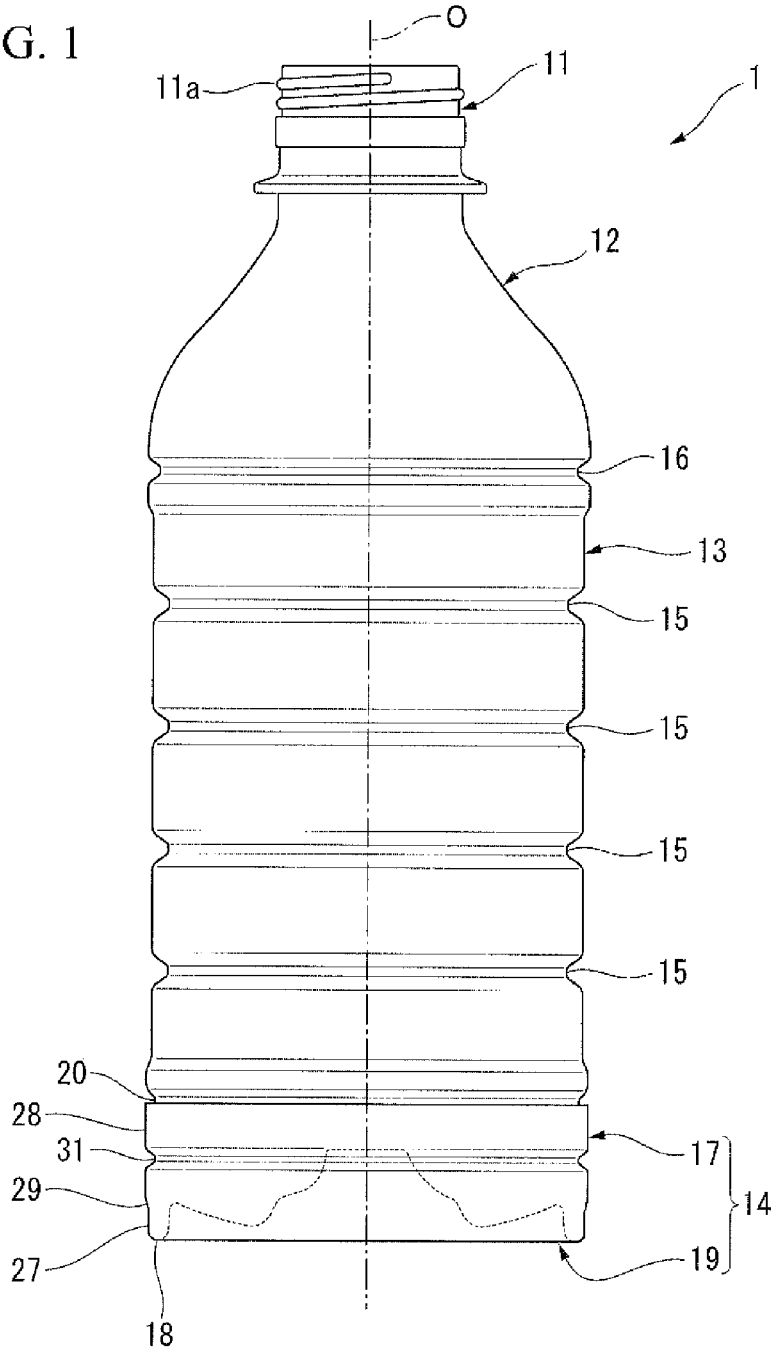
FIG. 1 is a side view of a bottle shown as an embodiment related to the present invention.
Figure 2:
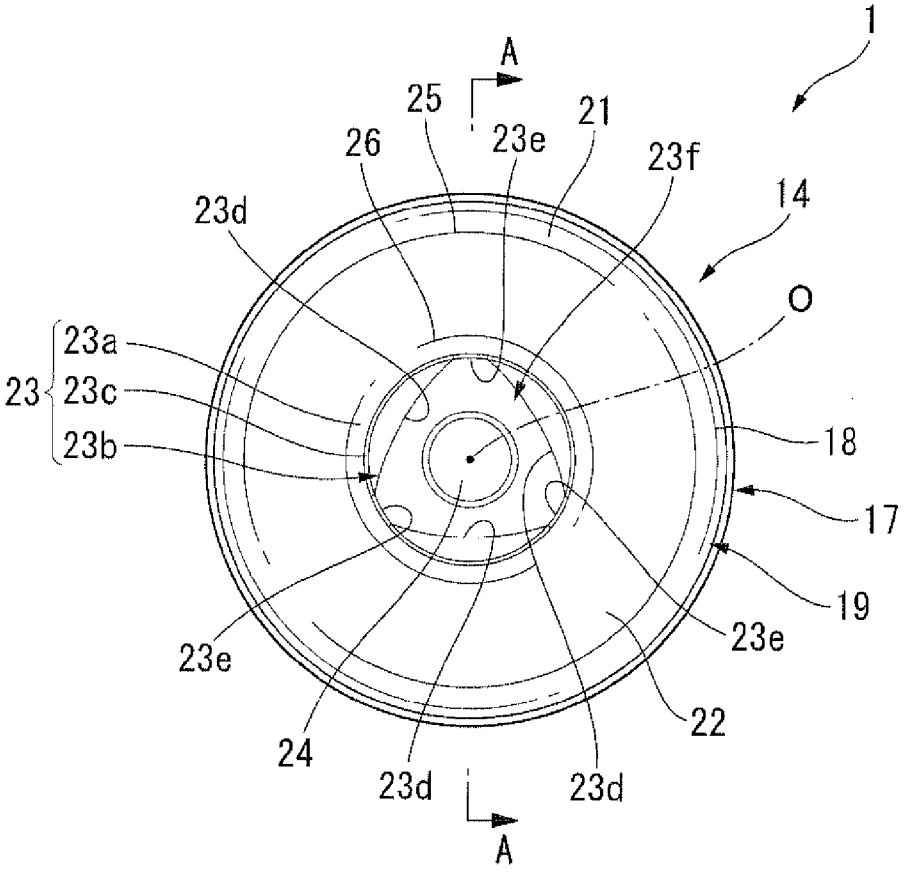
FIG. 2 is a bottom view of the bottle shown as the embodiment related to the present invention.
Figure 3:
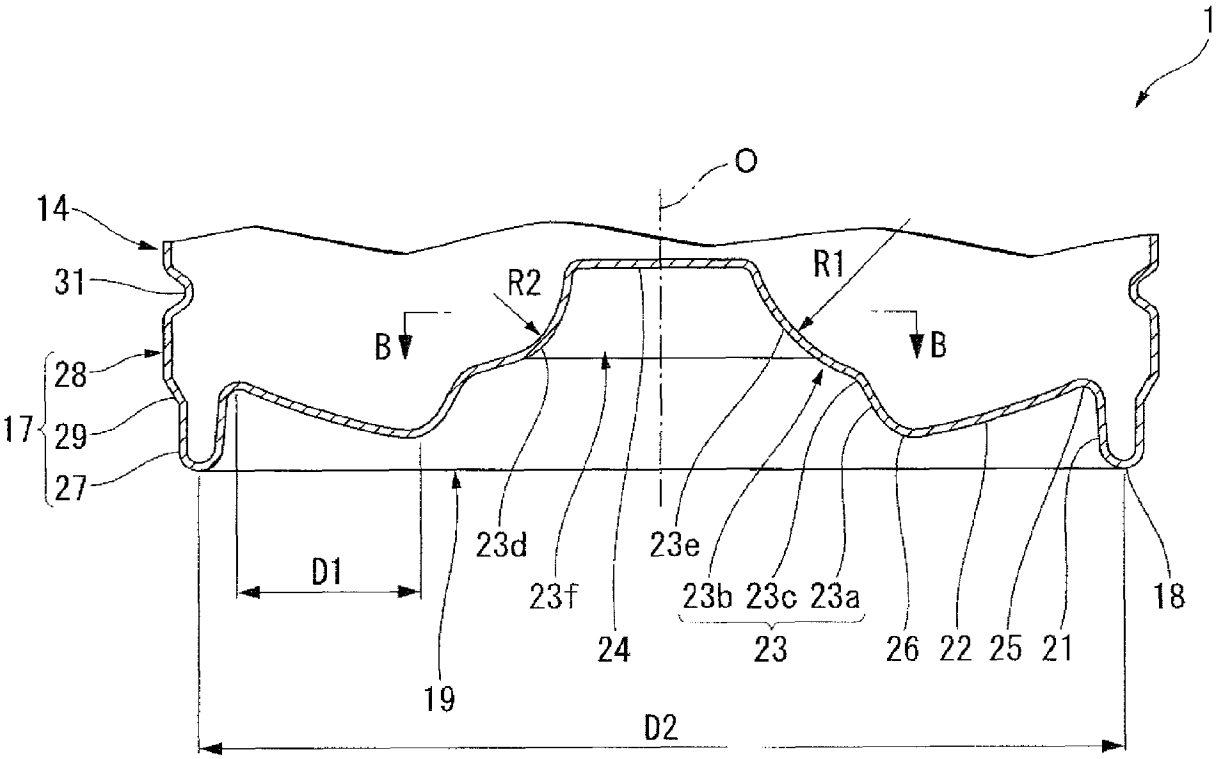
FIG. 3 is a cross-sectional view taken along line A-A of the bottle shown in FIG. 2.

As shown in FIGS. 1 to 3, the bottle 1 according to the present embodiment includes a mouth part 11, a shoulder part 12, a body part 13, and a bottom part 14. The mouth part 11, the shoulder part 12, the body part 13, and the bottom part 14 are schematically configured to be connected in that order with respective central axes thereof located on a common axis.

Hereinafter, the common axis is referred to as a bottle axis O. Along a direction of the bottle axis O, a side of the mouth part is referred to as an upper side, and a side of the bottom part 14 is referred to as a lower side. Further, directions perpendicular to the bottle axis O are referred to as radial directions of the bottle, and a direction revolving around the bottle axis O is referred to as a circumferential direction of the bottle.

Further, the bottle 1 is formed of a pre-form, which is formed in the shape of a bottomed cylinder by injection molding, by blow molding. Further, the bottle 1 is integrally formed of a synthetic resin material. Further, the mouth part 11 is provided with an external thread part 11*a* onto which a cap, which is not shown, is screwed. Furthermore, each of the mouth part 11, the shoulder part 12, the body part 13, and the bottom part 14 has a circular shape when viewed from the cross section perpendicular to the bottle axis O.

A connection part of the shoulder part 12 and the body part 13 is continuously formed with a first annular concave groove 16 throughout the circumference thereof.

The body part 13 is formed in a cylindrical shape, and a part between opposite ends of the direction of the bottle axis O is formed with a smaller diameter than the opposite ends. The body part 13 is continuously formed with a plurality of second annular concave grooves 15 throughout the circumference thereof at intervals in the direction of the bottle axis O. In the example shown in the figure, four second annular concave grooves 15 are formed at regular intervals in the direction of the bottle axis O.

A connection part of the body part 13 and the bottom part 14 is continuously formed with a third annular concave groove 20 throughout the circumference thereof.

The bottom part 14 is formed in the shape of a cup that has a heel part 17 whose upper end opening is connected to a lower end opening of the body part 13 and a bottom wall part 19 which blocks a lower end opening of the heel part 17 and whose outer circumferential edge becomes a grounding part 18.

The heel part 17 includes a heel lower end 27 connecting to the grounding part 18 from a radial outer side of the bottle, an upper heel part 28 connecting to the body part 13 from a lower side of the body part 13, and a connection part 29 connecting the heel lower end 27 and the upper heel part 28. The heel lower end 27 is formed with a smaller diameter than the upper heel part 28 connecting to the heel lower end 27 from an upper side of the heel lower end 27. The connection part 29 of the heel lower end 27 and the upper heel part 28 are gradually reduced in diameter from an upper side toward a lower side thereof. The upper heel part 28 becomes the maximum outer diameter part of the bottle 1, together with the opposite ends of the body part 13 in the direction of the bottle axis O. The upper heel part 28 has a fourth annular concave groove 31 that is continuously formed throughout the circumference thereof and that has approximately the same depth as the third annular concave groove 20.

Figure 4:
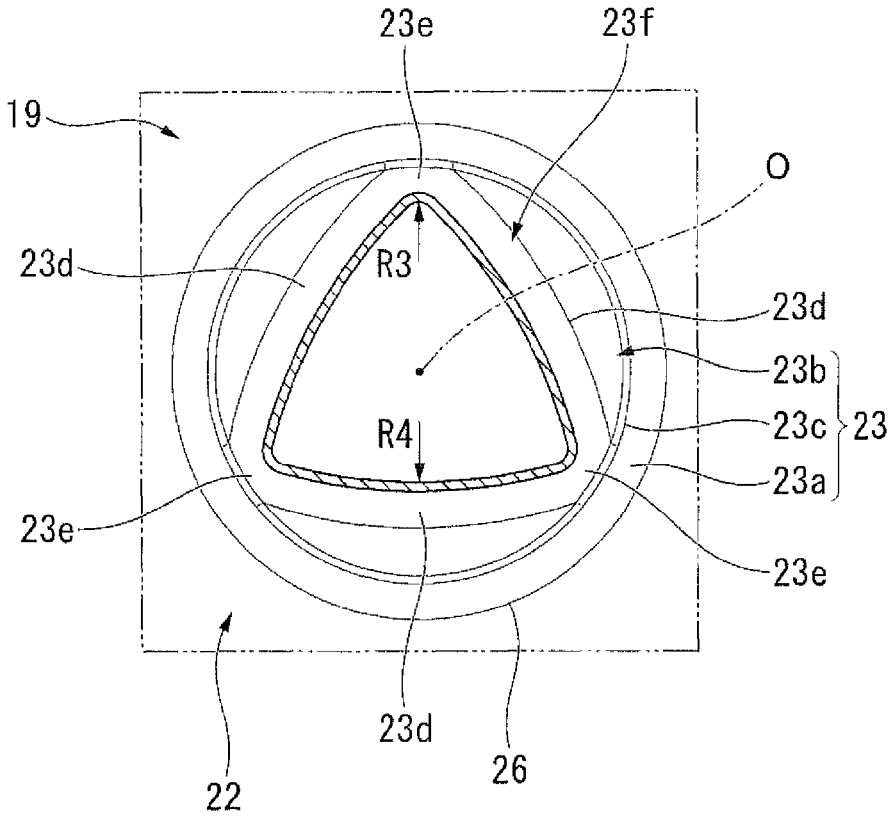
FIG. 4 is a cross-sectional view taken along line B-B of the bottle shown in FIG. 3.

As shown in FIGS. 2 to 4, the bottom wall part 19 includes a standing peripheral wall part 21 connecting to the grounding part 18 from the radial inner side of the bottle and extending upward, an annular movable wall part 22 protruding from an upper end of the standing peripheral wall part 21 toward the radial inner side of the bottle, a depression peripheral wall part 23 extending upward from an inner end of the movable wall part 22 in the radial direction of the bottle, and a closing wall part (disk-shaped top wall) 24 closing an upper end opening of the depression peripheral wall part 23.

As shown in FIG. 3, the grounding part 18 is substantially an annular portion, and is in line contact with a ground plane (not shown) at a ground diameter D2. For example, when a portion that establishes a ground for the ground plane is a plane, the ground diameter D2 becomes an average diameter passing through the center of the annular ground plane in the radial direction of the bottle.

Further, an annular width D1 of the movable wall part 22 taken in the radial direction of the bottle (i.e., a distance taken in the radial direction of the bottle between a curved surface part 25, which is a portion connected with the standing peripheral wall part 21, and a curved surface part 26, which is a portion connected with the depression peripheral wall part 23 and is to be described below) is within a range of 20% to 40% of the ground diameter D2 in the grounding part 18.

The standing peripheral wall part 21 is gradually reduced in diameter from a lower side toward an upper side thereof. The movable wall part 22 is formed in the shape of a curved surface protruding downward, and gradually extends downward from the radial outer side toward the radial inner side of the bottle. The movable wall part 22 and the standing peripheral wall part 21 are connected via the curved surface part 25 protruding upward. Thus, the movable wall part 22 is configured to freely pivot about the curved surface part 25 (the portion connected with the standing peripheral wall part 21) so as to move the depression peripheral wall part 23 in an upward direction.

The depression peripheral wall part 23 is disposed on the same axis as the bottle axis O, and is configured so that the closing wall part 24 disposed on the same axis as the bottle axis O is connected to an upper end thereof. The depression peripheral wall part 23 is gradually increased in diameter from an upper side toward a lower side thereof, and is formed to have multiple stages.

The depression peripheral wall part 23 includes a lower cylindrical part 23*a* that is gradually reduced in diameter from the inner end of the movable wall part 22 in the radial direction of the bottle toward the upper side thereof, an upper cylindrical part 23*b* that is gradually increased in diameter from an outer circumferential edge of the closing wall part 24 toward the lower side thereof is formed in the shape of a curved surface protruding downward, and a step part 23*c* that connects both of the cylindrical parts 23*a* and 23*b*, and is formed in the shape of a two-stage cylinder.

The lower cylindrical part 23*a* is connected to the inner end of the movable wall part 22 in the radial direction of the bottle via the curved surface part 26 protruding downward. The curved surface part 26 protrudes obliquely toward the radial inner side of the bottle in a downward direction. Further, the lower cylindrical part 23*a* is formed in a circular shape when viewed from the cross section thereof.

The step part 23*c* is formed in the shape of a concave surface recessed toward the radial outer side of the bottle. The circular step part 23*c* is located so as to be the same level as or above the upper end of the standing peripheral wall part 21.

The upper cylindrical part 23*b* is formed with overhang parts 23*d* projecting toward the radial inner side of the bottle. The overhang parts 23*d* are formed over nearly the entire length of the upper cylindrical part 23*b* in the direction of the bottle axis O excluding an upper end of the upper cylindrical part 23*b*, and are formed in succession in the circumferential direction of the bottle. In the shown example, the three overhang parts 23*d* adjoining each other in the upper cylindrical part 23*b* in the circumferential direction of the bottle are disposed at intervals in the circumferential direction of the bottle.

A shape of the upper cylindrical part 23*b* when viewed from the cross section thereof is changed from a polygonal shape (a nearly regular triangular shape in the example shown in the figure) to a circular shape from a lower side toward an upper side thereof by forming the overhang parts 23*d*. A shape of the upper end of the upper cylindrical part 23*b* when viewed from the cross section thereof is a circular shape. At a portion of the upper cylindrical part 23*b*, a shape of which is the polygonal shape when viewed from the cross section thereof, the overhang parts 23*d* become side parts of the polygonal shape, and midsections 23*e* located between the overhang parts 23*d* adjoining each other in the circumferential direction of the bottle become corner parts of the polygonal shape. In the example shown in the figure, the case in which the polygonal shape is the nearly regular triangular shape is given as an example. However, the present invention is not limited to this case.

Further, as shown in FIG. 2, when viewed from the cross section of the upper cylindrical part 23*b*, each of the overhang parts 23*d* and the midsections 23*e* is formed in the shape of a curved surface protruding toward the radial outer side thereof. Thus, the radius of curvature of the overhang part 23*d* when viewed from the cross section thereof is greater than that of the midsection 23*e* when viewed from the cross section thereof.

Furthermore, as shown in FIG. 3, when viewed from the longitudinal section of the upper cylindrical part 23*b*, each of the overhang parts 23*d* and the midsections 23*e* is formed in the shape of a curved surface protruding toward the radial inner side thereof. The radius of curvature of the overhang part 23*d* when viewed from the longitudinal section thereof is smaller than that of the midsection 23*e* when viewed from the longitudinal section thereof.

That is to say, as shown in FIGS. 2 to 4, the depression peripheral wall part 23 is formed with an angular cylindrical part 23*f* that has a polygonal shape having the overhang parts 23*d* at side parts thereof.

In the example shown in the figures, the angular cylindrical part 23*f* is formed on the upper cylindrical part 23*b* of the depression peripheral wall part 23. The angular cylindrical part 23*f* is formed over nearly the entire length of the upper cylindrical part 23*b* in the direction of the bottle axis O excluding the upper end of the upper cylindrical part 23*b*. Further, a shape of the angular cylindrical part 23*f* when viewed from the cross section thereof is a nearly regular triangular shape.

When viewed from the longitudinal section of the angular cylindrical part 23*f*, each of the midsections 23*e* and the overhang parts 23*d* is, as shown in FIG. 3, formed in the shape of a curved surface protruding toward the radial inner side of the bottle, and the curvature radius R1 of the midsection 23*e* is greater than that R2 of the overhang part 23*d*.

At a portion of the angular cylindrical part 23*f* from which an upper end thereof is excluded, when viewed from the cross section thereof, each of the midsections 23*e* and the overhang parts 23*d* is, as shown in FIG. 4, formed in the shape of a curved surface protruding toward the radial outer side of the bottle, and the curvature radius R3 of the midsection 23*e* is smaller than that R4 of the overhang part 23*d*. Further, the circumferential length of the midsection 23*e* is shorter than that of the overhang part 23*d*.

Furthermore, the shape of the angular cylindrical part 23*f* when viewed from the cross section thereof is changed from the polygonal shape into the circular shape from a lower side toward an upper side thereof. Thus, the upper end of the angular cylindrical part 23*f* formed in the circular shape when viewed from the cross section thereof is connected to an outer circumferential edge of the top wall 24.

When the interior of the bottle 1 configured as described above is decompressed, the movable wall part 22 pivots around the curved surface part 25 of the bottom wall part 19 in the upward direction. Thereby, the movable wall part 22 moves so as to lift the depression peripheral wall part 23 in an upward direction. That is, during the decompression, the bottom wall part 19 of the bottle 1 is positively deformed, and thereby deformation of the body part 13 is suppressed, and a change in internal pressure (decompression) of the bottle 1 can be absorbed.

Further, since the plurality of second annular groove parts 15 are formed in the body part 13, the body part 13 easily undergoes contraction deformation toward the bottle axis O. Accordingly, in addition to the decompression absorption caused by the deformation of the bottom wall part 19, the change in internal pressure of the bottle 1 can be further absorbed using the deformation of the body part 13. As a result, the performance of the decompression absorption of the interior of the bottle 1 can be further improved.

Particularly, since the second annular grooves 15 are groove parts having a depth of 2 mm or more, the rigidity against a transverse load of the body part 13 can be secured while the retractility of the body part 13 is secured. Accordingly, the inappropriate deformation of the body part 13 caused by bending can be prevented.

Further, since the depression peripheral wall part 23 is gradually increased in diameter from the upper side toward the lower side thereof and is formed to have multiple stages, a surface area of the depression peripheral wall part 23 can be increased. For this reason, the depression peripheral wall part 23 is formed by greatly stretching a synthetic resin material (pre-form) during blow molding of the bottle 1.

Further, since the depression peripheral wall part 23 is formed by greatly stretching the synthetic resin material during blow molding, a reduction in wall thickness of the depression peripheral wall part 23 can be achieved. Accordingly, when the interior of the bottle 1 is decompressed, it can be easy to move the depression peripheral wall part 23 in the upward direction. As a result, the performance of the decompression absorption of the interior of the bottle 1 can be further improved.

Furthermore, since the depression peripheral wall part 23 is formed by greatly stretching the synthetic resin material during blow molding, a degree of orientational crystallization in the depression peripheral wall part 23 can be increased. Accordingly, when a content in a heated state is filled, the depression peripheral wall part can be prevented from being deformed.

Furthermore, since the upper cylindrical part 23*b* is formed in the shape of the curved surface protruding in the downward direction in which the synthetic resin material is stretched during blow molding, it is possible to enhance fluidity of the synthetic resin material during blow molding, and to cause the synthetic resin material to smoothly flow with low resistance. As a result, the moldability of the bottle 1 can be further improved.

Further, since the annular width D1 of the movable wall part 22 is formed within the range of 20% to 40% of the ground diameter D2, the movable wall part 22 can be easily pivoted, and the amount of pivot thereof is easily increased. Accordingly, the movable wall part 22 can be flexibly deformed while following up the change in internal pressure of the interior of the bottle 1 with good sensitivity, and the decompression absorption of the interior of the bottle 1 can be stably performed.

Also, since the movable wall part 22 is easily moved downward during filling of the content, a volume of the interior of the bottle 1 during the filling is increased, and the capacity of the decompression absorption of the interior of the bottle 1 just after the filling can be increased. For this reason, the performance of the decompression absorption of the interior of the bottle 1 can be improved.

Further, since the angular cylindrical part 23*f* is formed on the depression peripheral wall part 23, during the decompression of the interior of the bottle 1, stress is easily concentrated on corresponding portions, which are equivalent in position to the midsections 23*e* forming the corner parts of the angular cylindrical parts 23*f* in the circumferential direction of the bottle, of the connection part of the movable wall part 22 and the depression peripheral wall part 23.

Accordingly, even when the wall thickness and rigidity in the movable wall part 22 and the depression peripheral wall part 23 are different at each position in the circumferential direction of the bottle, during the decompression of the interior of the bottle 1, the movable wall part 22 and the depression peripheral wall part 23 can be easily displaced toward the inner side of the bottle 1 throughout the circumferences thereof starting from the corresponding portions in the connection part. As a result, the performance of the decompression absorption of the interior of the bottle 1 can be stably exerted.

Further, when viewed from the longitudinal section of the angular cylindrical part 23*f*, the curvature radius R1 of the midsections 23*e* is greater than that R2 of the overhang parts 23*d*. As such, the stress occurring at the midsections 23*e* forming the corner parts of the angular cylindrical parts 23*f* can be suppressed. As a result, the strength of the bottom wall part 19 can be prevented from being reduced by forming the angular cylindrical part 23*f* on the depression peripheral wall part 23.

Furthermore, since the shape of the angular cylindrical part 23*f* when viewed from the cross section thereof is gradually changed from the polygonal shape into the circular shape from the lower side toward the upper side thereof, an increase in stress concentration points caused by forming the angular cylindrical part 23*f* on the depression peripheral wall part 23 can be suppressed. As a result, the strength of the bottom wall part 19 can be reliably prevented from being reduced.

Further, since the depression peripheral wall part 23 is gradually increased in diameter from the upper side toward the lower side thereof, during the decompression of the interior of the bottle 1, a raising force is easily applied to the depression peripheral wall part 23 toward the inner side of the bottle 1. As a result, the movable wall part 22 and the depression peripheral wall part 23 can be reliably displaced toward the inner side of the bottle 1.

Furthermore, when the bottle 1 is formed by the blow molding, the moldability of the bottle can be improved.

Modified Examples

Hereinafter, a bottle 40 according to a modified example of the embodiment of the present invention will be described with reference to FIGS. 5 and 6. A movable wall part 22 of the bottle 40 has a plurality of ribs 41 radially disposed around the bottle axis O. That is, the ribs 41 are disposed at regular intervals in the circumferential direction of the bottle. Further, each rib 41 is formed in such a manner that a shape thereof when viewed from the longitudinal section thereof in the radial direction of the bottle is a wave form.

In the example shown in the figure, each rib 41 is configured so that a plurality of concave parts 41*a* recessed upward in a curved surface extend intermittently and linearly in the radial direction of the bottle.

The concave parts 41*a* are formed in the same shape and the same size. Further, the concave parts 41*a* are disposed at regular intervals in the radial direction of the bottle. Thus, the plurality of ribs 41 has the same positions in the radial direction of the bottle in which the plurality of the concave parts 41*a* are disposed.

In each of the ribs 41, among the plurality of concave parts 41*a*, the concave part 41*a* located at a radial outermost side of the bottle is adjacent to the curved surface part 25 from the radial inner side of the bottle. Further, the concave part 41*a* located at a radial innermost side of the bottle is adjacent to the depression peripheral wall part 23 from the radial outer side of the bottle.

Further, in the bottle 40, a standing peripheral wall part 21 is formed with an uneven part 42 throughout the circumference thereof. The uneven part 42 is formed in such a manner that a plurality of protrusion parts 42*a* formed in the shape of a curved surface protruding toward the radial inner side of the bottle are disposed at intervals in the circumferential direction of the bottle.

When an interior of the bottle 40 configured as described above is decompressed, the movable wall part 22 pivots upward around the curved surface part 25 of the bottom wall part 19. Thereby, the movable wall part 22 moves so as to lift the depression peripheral wall part 23 in an upward direction. That is, during the decompression, the bottom wall part 19 of the bottle 40 is positively deformed, and thereby deformation of the body part 13 is suppressed, and a change in internal pressure (decompression) of the bottle 40 can be absorbed.

Further, since a plurality of second annular groove parts 15 are formed in the body part 13, the body part 13 easily undergoes contraction deformation toward the bottle axis O. For this reason, in addition to the decompression absorption caused by the deformation of the bottom wall part 19, the change in internal pressure of the bottle 40 can be further absorbed using the deformation of the body part 13. As a result, the performance of the decompression absorption of the interior of the bottle 40 can be further improved.

Particularly, since the second annular grooves 15 are groove parts having a depth of 2 mm or more, the rigidity against a transverse load of the body part 13 can be secured while the flexibility of the body part 13 is secured. Accordingly, the inappropriate deformation of the body part 13 caused by bending can be prevented.

Further, since the plurality of ribs 41 are formed on the movable wall part 22 of the bottom wall part 19, a pressure receiving area can be increased by increasing a surface area of the movable wall part 22. Accordingly, the movable wall part 22 can be deformed in rapid response to the change in internal pressure of the bottle 40.

Also, since the uneven part 42 is formed on the standing peripheral wall part 21, light incident upon, for instance, the standing peripheral wall part 21 is subjected to diffused reflection by the uneven part 42, or a content in the bottle 40 is filled even in the uneven part 42. Thereby, when an observer looks at a bottom part 14 of the bottle 40 in which the content is filled, a sense of discomfort which the observer feels can be reduced.

Embodiments

Next, a description will be made of an embodiment in which a test (analysis) of a change in a ratio of the annular width D1 of the movable wall part 22 to the ground diameter D2 and of how the relationship between decompression strength and decompression absorption capacity is changed in each change of the ratio was performed. Results of the analysis are shown in FIG. 7.

Figure 5:
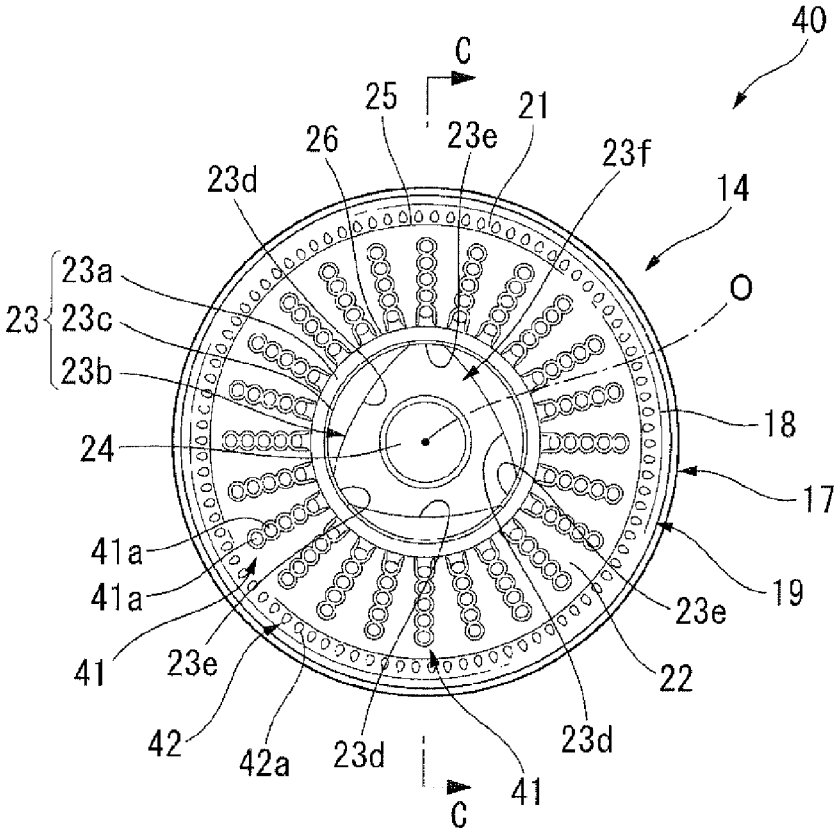
FIG. 5 is a bottom view of a bottle shown as a modified example of the embodiment related to the present invention.
Figure 6:
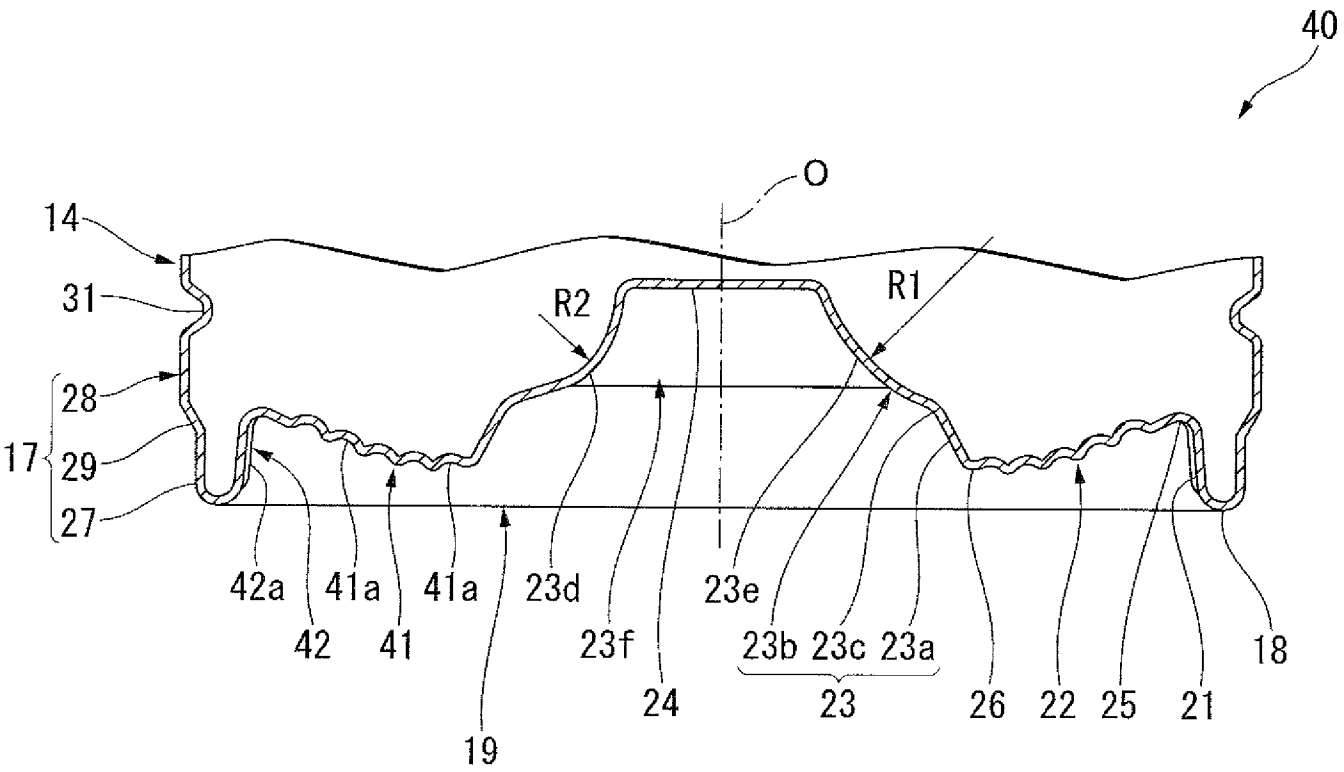
FIG. 6 is a cross-sectional view taken in the direction of the arrows along line C-C of the bottle shown in FIG. 5.

This test was performed using the bottle 40 shown in FIGS. 5 and 6 in which the plurality of ribs 41 are formed on the movable wall part 22 and serves as a reference of the bottle 1 shown in FIGS. 1 to 4 in which the plurality of ribs 41 are not provided.

In this test, the test (analysis) was performed by changing the ratio of the annular width D1 of the movable wall part 22 to the ground diameter D2 in three steps. The ratio was changed by changing the standing peripheral wall part 21 in the radial direction of the bottle without changing the shape of the depression peripheral wall part 23. That is, the test was performed in each of a case in which the annular width D1 was set to 18.5% of the ground diameter D2 (line A of the figure), a case in which the annular width D1 was set to 21.5% of the ground diameter D (line B of the figure), and a case in which the annular width D1 was set to 24.0% of the ground diameter D (line C of the figure).

Figure 7:
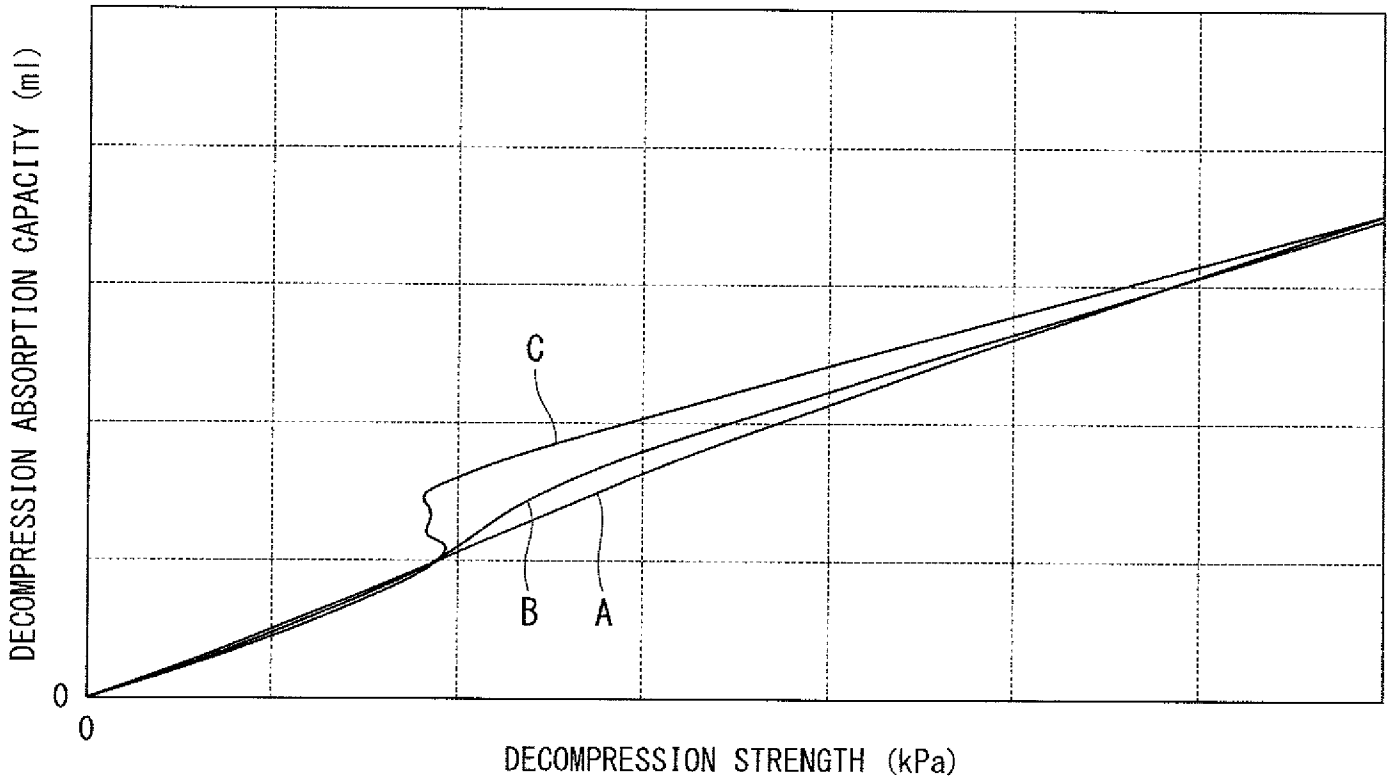
FIG. 7 is a view analyzing results of testing the bottle related to the present invention, and a relationship diagram of decompression strength and decompression absorption capacity.

As shown in FIG. 7, in all cases, it could be confirmed that the decompression absorption capacity was increased with an increase in the decompression strength. This is considered to be due to the fact that the entire bottom wall part 19 moved upward due to the decompression of the interior of the bottle 40.

Among the cases, in the case in which the annular width D1 was set to 24.0% of the ground diameter D2 (line C of the figure), it was confirmed that the decompression absorption capacity was suddenly increased in the middle of increasing the decompression strength. This is considered to be due to the fact that, in addition to that the entire bottom wall part 19 moving upward, the movable wall part 22 easily pivoted around the curved surface part 25 because the annular width D1 was wide, and the inner end side thereof moved upward due to inversion deformation to thereby further move the depression peripheral wall part 23 in the upward direction.

In contrast, in the ease in which the annular width D1 was set to 18.5% of the ground diameter D2 (line A of the figure), it could be confirmed only that the decompression absorption capacity was increased by the upward movement of the entire bottom wall part 19 without the aforementioned inversion phenomenon of the movable wall part 22.

Further, in the case in which the annular width D1 was set to 21.5% of the ground diameter D2 (line B of the figure), it could be confirmed that, although not as much as in the case of being set to 24.0%, the decompression absorption capacity was slightly increased due to the inversion phenomenon of the movable wall part 22.

It could be confirmed from the above that, by setting the annular width D1 of the movable wall part 22 to 20% or more of the ground diameter D2, the movable wall part 22 was smoothly deformed to stably perform the decompression absorption of the interior of the bottle.

Incidentally, the bottle according to the present invention is especially preferably used for a bottle having an internal volume of 1 liter or less (in which the ground diameter D2 is a maximum of 80 mm or so). If the length of the annular width D1 is increased to further increase the aforementioned inversion phenomenon of the movable wall part 22, the size of the depression peripheral wall part 23 or the top wall 24 is reduced to the same extent. As a result, there is a risk of incurring a disadvantage of a problem with the moldability of the bottle, or difficulty in a design of a molding machine. For this reason, in view of these points, an upper limit of the annular width D1 of the movable wall part 22 may be 40% or less of the ground diameter D2.

The technical scope of the present invention is not limited to the aforementioned embodiments, but the present invention may be modified in various ways without departing from the scope of the present invention.

For example, the standing peripheral wall part 21 may be appropriately modified by, for example, being extended in parallel in the direction of the bottle axis O.

Further, the movable wall part 22 may be appropriately modified, for instance, may protrude in the radial direction of the bottle in parallel, or be inclined upward. Furthermore, the movable wall part 22 may be appropriately modified by, for example, being formed in a planar shape or in the shape of a concave surface recessed upward.

Also, a two-stage cylinder is shown as the depression peripheral wall part 23, but a cylinder of three or more stages may be used.

Further, in the aforementioned embodiment, the upper cylindrical part 23*b* is configured to be formed in the shape of the curved surface protruding downward, but it is not limited thereto.

Furthermore, in the aforementioned embodiment, the overhang parts 23*d*, which are adjacent to each other in the circumferential direction of the bottle, are configured to be disposed at intervals in the circumferential direction of the bottle, but are not limited thereto. For example, the overhang parts 23*d* may be disposed in the circumferential direction of the bottle with no interval, and may be directly coupled to each other. In this case, in the upper cylindrical part 23*b*, the portion at which the overhang parts 23*d* are disposed may have the circular shape when viewed from the cross section thereof. However, the upper cylindrical part 23*b* may have the circular shape over its entire length of the direction of the bottle axis when viewed from the cross section thereof. Alternatively, the overhang parts 23*d* may be omitted.

Furthermore, in the aforementioned embodiment, each of the shoulder part 12, the body part 13, and the bottom part 14 is configured so that the shape thereof is the circular shape when viewed from the cross section thereof perpendicular to the bottle axis O, and, without being limited to this, it may be appropriately modified, for instance to a polygonal shape. Depending on the number of angles of the bottle 1 itself, the number and position of the overhang parts 23*d* may be appropriately modified.

Furthermore, the angular cylindrical part 23*f* may be formed on the lower cylindrical part 23*a*, and the lower end of the angular cylindrical part 23*f* may be located at the lower end of the lower cylindrical part 23*a*.

Further, the synthetic resin material of which the bottle 1 is formed may be appropriately modified into, for example, polyethylene terephthalate, polyethylene naphthalate, an amorphous polyester, or a blend material thereof. Furthermore, the bottle 1 or 40 is not limited to a single layer structure, and may be a stacked structure having an intermediate layer. The intermediate layer may include, for example, a layer formed of a resin material having a gas barrier characteristic, a layer formed of a recycled material, or a layer formed of a resin material having oxygen absorbability.

In addition, the components in the embodiment can be appropriately replaced with well-known components without departing from the scope of the invention. Further, the aforementioned modifications may be combined.

INDUSTRIAL APPLICABILITY

According to the bottle related to the present invention, the decompression absorption of the interior of the bottle can be stabilized, and the performance of the decompression absorption of the interior of the bottle can be improved.

DESCRIPTION OF REFERENCE NUMERALS

O bottle axis
D1 annular width of movable wall part
D2 ground diameter
1, 40 bottle
14 bottom part
18 grounding part
19 bottom wall part
21 standing peripheral wall part
22 movable wall part
23 depression peripheral wall part
23*a* lower cylindrical part
23*b* upper cylindrical part
23*c* step part
23*d* overhang part
23*e* midsection
23*f* angular cylindrical part
24 closing wall part (disc-shaped top wall)

25 curved surface part (connection part connected with standing peripheral wall part)

The invention claimed is:

1. A bottle formed of a synthetic resin material in a shape of a bottomed cylinder by blow molding, the bottle comprising:

a bottom wall part of a bottom part including:

a grounding part located at an outer circumferential edge of the bottom wall part, a standing peripheral wall part configured to connect to the grounding part from a radial inner side of the bottle and to extend upward, an annular movable wall part configured to protrude from an upper end of the standing peripheral wall part toward the radial inner side of the bottle, and a depression peripheral wall part configured to extend upward from an inner end of the movable wall part in a radial direction of the bottle, wherein the movable wall part is disposed to freely pivot around a connection part connected with the standing peripheral wall part so as to move the depression peripheral wall part in an upward direction, and the depression peripheral wall part is formed to have multiple stages, an annular width of the movable wall part in the radial direction of the bottle is within a range of 20% to 40% of a ground diameter in the grounding part, and the depression peripheral wall part is formed with an angular cylindrical part of a polygonal shape in which a plurality of overhang parts projecting toward the radial inner side of the bottle are formed in succession in a circumferential direction of the bottle, and thereby a shape of the angular cylindrical part when viewed from a cross section thereof is configured so that midsections located between the plurality of overhang parts adjoining each other in the circumferential direction of the bottle become corner parts and so that the plurality of overhang parts become side parts, and when viewed from a longitudinal section of the angular cylindrical part, each of the midsections and each of the plurality of overhang parts is formed as a curved surface protruding toward the radial inner side of the bottle, and a radius of curvature of each of the midsections is greater than that of each of the plurality of overhang parts.

2. The bottle according to claim 1, wherein:

the bottom wall part includes a closing wall part closing an upper end opening of the depression peripheral wall part, the depression peripheral wall part includes a lower cylindrical part that is gradually reduced in diameter from the inner end of the movable wall part in the radial direction of the bottle toward an upper side of the lower cylindrical part, an upper cylindrical part that is gradually increased in diameter from an outer circumferential edge of the closing wall part toward a lower side of the upper cylindrical part, and a step part that connects both of the cylindrical parts, and the upper cylindrical part is formed in a shape of a curved surface protruding downward.

3. The bottle according to claim 1, wherein a shape of the angular cylindrical part when viewed from a cross section thereof is gradually deformed from the polygonal shape into a circular shape from a lower side toward an upper side of the angular cylindrical part.

4. The bottle according to claim 1, wherein the depression peripheral wall part is gradually increased in diameter from an upper side toward a lower side of the depression peripheral wall part.

5. The bottle according to claim 2, wherein a shape of the angular cylindrical part when viewed from a cross section thereof is gradually deformed from the polygonal shape into a circular shape from a lower side toward an upper side of the angular cylindrical part.

6. The bottle according to claim 2, wherein the depression peripheral wall part is gradually increased in diameter from an upper side toward a lower side of the depression peripheral wall part.

7. The bottle according to claim 3, wherein the depression peripheral wall part is gradually increased in diameter from an upper side toward a lower side of the depression peripheral wall part.

8. The bottle according to claim 5, wherein the depression peripheral wall part is gradually increased in diameter from an upper side toward a lower side of the depression peripheral wall part.

* * * * *